US008844746B2

(12) United States Patent
Meyers et al.

(10) Patent No.: US 8,844,746 B2
(45) Date of Patent: Sep. 30, 2014

(54) LIQUID CONTAINER CLOSURE WITH INTEGRATED OVER CENTER LATCHING ASSEMBLY

(75) Inventors: David O. Meyers, Kaysville, UT (US); Steven M. Sorensen, Alpine, UT (US); Kim Sorensen, Alpine, UT (US)

(73) Assignee: Runway Blue, LLC, Lehi, UT (US)

( * ) Notice: Subject to any disclaimer, the term of this patent is extended or adjusted under 35 U.S.C. 154(b) by 29 days.

(21) Appl. No.: 13/232,891

(22) Filed: Sep. 14, 2011

(65) Prior Publication Data

US 2013/0062304 A1 Mar. 14, 2013

(51) Int. Cl.

| | |
|---|---|
| ***B65D 43/26*** | (2006.01) |
| ***B65D 43/22*** | (2006.01) |
| ***A47G 19/22*** | (2006.01) |
| ***B65D 43/00*** | (2006.01) |

(52) U.S. Cl.

CPC ..... *B65D 43/00* (2013.01); *B65D 43/26* (2013.01)

USPC ..... 220/264; 220/715; 220/254.5; 220/326; 222/556; 215/237

(58) Field of Classification Search

USPC ..... 220/254.3, 254.5, 324, 326, 263, 264, 220/715, 830, 835; 215/235, 237, 244, 387, 215/330, 331, 240; 222/556

See application file for complete search history.

(56) References Cited

U.S. PATENT DOCUMENTS

| | | | | |
|---|---|---|---|---|
| 1,094,469 | A | 4/1914 | Pick | |
| 1,389,732 | A | 9/1921 | Baron | |
| 1,573,620 | A | 2/1926 | Allston | |
| 2,056,879 | A | 10/1936 | Winterhalter et al. | |
| 2,272,867 | A | 2/1942 | Cobel | |
| 2,514,573 | A | 7/1950 | Harrison | |
| 2,573,378 | A | 10/1951 | Zurlinden | |
| 2,574,876 | A * | 11/1951 | Lebus | 222/473 |

(Continued)

FOREIGN PATENT DOCUMENTS

| | | |
|---|---|---|
| CN | 201139196 | 10/2008 |
| JP | 2006103793 A | 4/2004 |
| JP | 2008247404 | 10/2008 |

OTHER PUBLICATIONS

International Preliminary Report on Patentability from PCT/US2012/054483, dated Mar. 18, 2014.

(Continued)

*Primary Examiner* — Fenn Mathew
*Assistant Examiner* — James N Smalley
(74) *Attorney, Agent, or Firm* — Maschoff Brennan

(57) ABSTRACT

Closures having an integrated over center latching assembly including an end wall, a skirt wall depending from the end wall, an outlet opening associated with the end wall and an over center latching assembly are disclosed. The over center latching assembly includes a link pivotally coupled to the closure at a first pivot point, a lever pivotally coupled to the link at a second pivot point, a closing member pivotally coupled to the closure at a third pivot point and pivotally coupled to the lever at a forth pivot point and a biasing spring coupled between the first pivot point and the fourth pivot point. The link and the lever are configured to move the over center latching assembly between a first position and a second position and the closing member is configured to close the outlet opening when the over center latching assembly is moved to the second position.

25 Claims, 5 Drawing Sheets

(56) References Cited

U.S. PATENT DOCUMENTS

| | | | | |
|---|---|---|---|---|
| 2,575,299 | A | 11/1951 | Scheel | |
| 2,638,253 | A * | 5/1953 | Mueller | 222/472 |
| 2,748,997 | A | 6/1956 | Richmond, Sr. | |
| 2,752,971 | A | 7/1956 | Tupper | |
| 2,754,866 | A | 7/1956 | Coltman | |
| 3,091,361 | A | 5/1963 | Gawron | |
| 3,143,205 | A | 8/1964 | Ruderian | |
| 3,144,016 | A | 8/1964 | Basci | |
| 3,168,226 | A | 2/1965 | Underwood | |
| 3,369,691 | A | 2/1968 | Wei | |
| 3,552,548 | A | 1/1971 | Wallestad et al. | |
| 3,820,692 | A | 6/1974 | Swett et al. | |
| D233,116 | S | 10/1974 | Swett et al. | |
| 4,022,352 | A | 5/1977 | Pehr | |
| 4,136,799 | A | 1/1979 | Albert | |
| 4,158,902 | A | 6/1979 | Chernack et al. | |
| D261,088 | S | 10/1981 | Akimov et al. | |
| 4,399,926 | A | 8/1983 | Eidels-Dubovoy | |
| 4,457,458 | A | 7/1984 | Heinol | |
| 4,474,303 | A | 10/1984 | Maccise | |
| 4,519,518 | A * | 5/1985 | Wiles et al. | 215/331 |
| 4,537,044 | A | 8/1985 | Putnam | |
| 4,735,333 | A | 4/1988 | Lay et al. | |
| 4,776,501 | A | 10/1988 | Ostrowsky | |
| 4,805,790 | A | 2/1989 | Leonetti et al. | |
| 4,932,225 | A | 6/1990 | Bighouse | |
| 5,065,911 | A | 11/1991 | Rohr et al. | |
| 5,088,614 | A | 2/1992 | Dumestre | |
| D330,862 | S | 11/1992 | Shibley et al. | |
| 5,228,584 | A | 7/1993 | Williams, Jr. | |
| D342,898 | S | 1/1994 | Cane | |
| D350,460 | S | 9/1994 | Picozza et al. | |
| 5,386,922 | A | 2/1995 | Jordan | |
| D356,499 | S | 3/1995 | Cautereels et al. | |
| 5,547,111 | A | 8/1996 | Geiger et al. | |
| 5,609,277 | A | 3/1997 | McDonald | |
| D382,968 | S | 8/1997 | Giles et al. | |
| D404,305 | S | 1/1999 | De Baschmakoff | |
| D405,654 | S | 2/1999 | Moran | |
| D421,547 | S | 3/2000 | Demers | |
| 6,161,713 | A * | 12/2000 | Krich | 215/384 |
| 6,283,333 | B1 | 9/2001 | Knickerbocker et al. | |
| 6,299,005 | B1 | 10/2001 | Higgins | |
| 6,379,032 | B1 | 4/2002 | Sorensen | |
| D458,081 | S | 6/2002 | Bodum | |
| D461,420 | S | 8/2002 | Kerman | |
| D497,431 | S | 10/2004 | Bentley | |
| 6,860,397 | B1 | 3/2005 | Walters, Jr. | |
| D504,273 | S | 4/2005 | Ancona | |
| D508,185 | S | 8/2005 | Gauss | |
| D510,235 | S | 10/2005 | Sorensen | |
| D518,336 | S | 4/2006 | Hirani | |
| 7,073,678 | B1 | 7/2006 | Dibdin et al. | |
| D526,827 | S | 8/2006 | Allen et al. | |
| D528,862 | S | 9/2006 | Li | |
| D529,339 | S | 10/2006 | Carreno et al. | |
| D532,650 | S | 11/2006 | de Groote | |
| D543,454 | S | 5/2007 | Leoncavallo et al. | |
| D546,131 | S | 7/2007 | Morales | |
| D547,607 | S | 7/2007 | Forsman | |
| D565,353 | S | 4/2008 | Roth et al. | |
| D574,190 | S | 8/2008 | Homma | |
| D580,227 | S | 11/2008 | Roth et al. | |
| D586,184 | S | 2/2009 | Miller et al. | |
| D587,069 | S | 2/2009 | Bodum | |
| D589,751 | S | 4/2009 | Liu et al. | |
| D592,913 | S | 5/2009 | Pinelli et al. | |
| 7,533,783 | B2 | 5/2009 | Choi et al. | |
| D593,811 | S | 6/2009 | Carreno | |
| D599,664 | S | 9/2009 | Fujinami et al. | |
| D604,103 | S | 11/2009 | Alviar et al. | |
| D609,970 | S | 2/2010 | Richau et al. | |
| D613,110 | S | 4/2010 | Lane et al. | |
| D622,089 | S | 8/2010 | Daniel et al. | |
| D622,554 | S | 8/2010 | Carreno | |
| 7,806,284 | B2 | 10/2010 | Mangano | |
| D626,837 | S | 11/2010 | Meyers et al. | |
| D626,838 | S | 11/2010 | Meyers et al. | |
| D628,483 | S | 12/2010 | McKinney et al. | |
| D629,657 | S | 12/2010 | Carreno | |
| 7,870,980 | B2 | 1/2011 | Wilson et al. | |
| D641,594 | S | 7/2011 | Huang | |
| D644,065 | S | 8/2011 | Llerena | |
| 8,020,257 | B2 | 9/2011 | Merten et al. | |
| D646,546 | S | 10/2011 | Robinson et al. | |
| D646,919 | S | 10/2011 | Nilsson | |
| D647,760 | S | 11/2011 | Pearson | |
| D652,256 | S | 1/2012 | Eyal | |
| D655,131 | S | 3/2012 | Nilsson | |
| D655,967 | S | 3/2012 | Bodum | |
| D656,357 | S | 3/2012 | Enghard | |
| D661,551 | S | 6/2012 | Gilbert | |
| D666,047 | S | 8/2012 | Lin | |
| D666,061 | S | 8/2012 | Ying | |
| D667,694 | S | 9/2012 | Meyers et al. | |
| 8,302,796 | B1 | 11/2012 | Johnson | |
| 8,342,349 | B2 | 1/2013 | Lu | |
| D677,121 | S | 3/2013 | Meyers et al. | |
| D686,885 | S | 7/2013 | Meyers et al. | |
| D686,886 | S | 7/2013 | Meyers et al. | |
| D686,887 | S | 7/2013 | Meyers et al. | |
| D686,888 | S | 7/2013 | Meyers et al. | |
| 2002/0074334 | A1 | 6/2002 | Karp | |
| 2003/0085228 | A1 | 5/2003 | Oakes | |
| 2004/0262306 | A1 | 12/2004 | Smith | |
| 2005/0045636 | A1 * | 3/2005 | Lown et al. | 220/259.1 |
| 2007/0012693 | A1 | 1/2007 | Kummer | |
| 2007/0175931 | A1 | 8/2007 | Leoncavallo et al. | |
| 2008/0099514 | A1 | 5/2008 | Carter et al. | |
| 2009/0178940 | A1 | 7/2009 | Said | |
| 2009/0188884 | A1 | 7/2009 | Nelson et al. | |
| 2009/0188933 | A1 | 7/2009 | Daams | |
| 2009/0301990 | A1 | 12/2009 | Cresswell et al. | |
| 2010/0200438 | A1 | 8/2010 | Davies | |
| 2010/0206835 | A1 | 8/2010 | Yu | |
| 2010/0224631 | A1 * | 9/2010 | Roth et al. | 220/288 |

OTHER PUBLICATIONS

U.S. Appl. No. 12/762,292, filed Apr. 16, 2010, Meyers, et al.
U.S. Appl. No. 13/232,935, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/609,238, filed Sep. 10, 2012, Meyers, et al.
U.S. Appl. No. 13/633,864, filed Oct. 2, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.
U.S. Appl. No. 61/832,085, filed Jun. 6, 2013, Sorensen, et al.
Kor One, http://www.korwater.com/buyONE, accessed Apr. 21, 2010.
Core 77, http://www.core77.com/blog/materials/kor.sub.--one.sub.--water.su-b.--vessel.sub.--actual.sub.--size.sub.--10211.asp, accessed Apr. 21, 2010.
Koyono, http://www.koyono.com/KOR-ONE-Green-Zen-Water-Hydration-Vessel.sub-.--p/kor-one.htm, accessed Apr. 21, 2010.
Fit Sugar, www.fitsugar.com/2496788, accessed Apr. 21, 2010.
Thermos, http://www.shopthermos.com/detail/TMS+HP4000GR6, accessed Apr. 21, 2010.
Goodlifter, http://www.goodlifer.com/2009/02/360-paper-water-bottle/, Apr. 21, 2010.
Notice of Allowance from U.S. Appl. No. 29/430,882 dated Aug. 5, 2013 (copy attached).
Advisory Action from U.S. Appl. No. 12/762,292 dated May 24, 2013 (copy attached).
Office Action from U.S. Appl. No. 12/762,292 dated Jul. 1, 2013 (copy attached).
Office Action from U.S. Appl. No. 12/762,292 dated Oct. 2, 2012 (copy attached).
Office Action from U.S. Appl. No. 12/762,292 dated Jul. 17, 2012 (copy attached).
Office Action from U.S. Appl. No. 12/762,292 dated Feb. 10, 2012 (copy attached).

(56) References Cited

OTHER PUBLICATIONS

Notice of Allowance from U.S. Appl. No. 29/431,544 dated Aug. 14, 2013 (copy attached).
Office Action from U.S. Appl. No. 29/431,544 dated Mar. 25, 2013 (copy attached).
Office Action from U.S. Appl. No. 13/633,864 dated Mar. 29, 2013 (copy attached).
Office Action from U.S. Appl. No. 13/609,238 dated May 30, 2013 (copy attached).
International Search Report from PCT Application No. PCT/US2011/026508 dated Sep. 29, 2011 (copy attached).
Written Opinion from PCT Application No. PCT/US2011/026508 dated Sep. 29, 2011 (copy attached).
International Preliminary Report on Patentability from PCT Application No. PCT/US2011/026508 dated Oct. 16, 2012 (copy attached).
International Search Report from PCT Application No. PCT/US2012/054483 dated Nov. 16, 2012 (copy attached).
International Search Report and Written Opinion from PCT Application No. PCT/US2012/054497 dated Nov. 20, 2012 (copy attached).
International Search Report and Written Opinion from PCT Application No. PCT/US2013/052132 dated Aug. 16, 2013 (copy attached).

* cited by examiner

LIQUID CONTAINER CLOSURE WITH INTEGRATED OVER CENTER LATCHING ASSEMBLY

BACKGROUND OF THE INVENTION

1. Field of the Invention

The present invention relates to closures incorporating an integrated latching assembly, and more particularly to closures with an integrated over center latching assembly for liquid containers such as bottles.

2. Background and Related Art

Various types of bottles or containers have been developed in the past that include a closure to provide selective dispensing of liquid from the container. Typically, the closure is removably attached to the neck of the container so a user can remove the closure to add liquid, wet or dry ingredients, ice or other products into the container. The closure is then screwed or snapped onto the neck of the container to provide a generally watertight and leak-proof seal.

When a user desires to drink liquid from the container, the closure may be removed by unscrewing the closure to provide access into a reservoir of the container. The user drinks from an opening formed by the neck of the container and then replaces the closure onto the container to re-seal the container. In some instances, such as for outdoor activities (biking or hiking being examples), it is oftentimes desirable to have a closure provided with an outlet for faster access than that obtained by completely removing the closure, such as a push/pull spout or a flip top.

Push/pull spouts, flip tops and similar outlet mechanisms provide a certain amount of efficiency and ease of dispensing the contents of a container/bottle in lieu of removing the closure altogether. However, such mechanisms have limitations. For example, because a flip top cap snaps over a spout opening and is typically secured by friction, the flip top closure is not as secure as a screw-type closure. If a bottle/container is squeezed, dropped or develops internal pressure, for example, the internal pressure may be sufficient to overcome the friction holding the flip top cap against the spout and the contents of the bottle/container may be spilled. Push/pull spouts have similar limitations. In addition, because such mechanisms rely on friction between adjacent components, as the components wear during the course of use the closure may increasingly leak over time or extended use. Moreover, as such mechanisms wear, it is difficult to tactilely discern when the push/pull spout or flip top cap is in the fully closed position and the contents of the bottle/container may be inadvertently allowed to leak or pour out.

Thus, while techniques currently exist that are used to selective permit the contents of a bottle/container to be dispensed without requiring removal of the entire closure, challenges still exist. Accordingly, it would be an improvement in the art to augment or even replace current techniques with other techniques.

BRIEF SUMMARY OF THE INVENTION

A bottle/container closure with an integrated over center latching assembly is described.

Some implementations of the invention provide a lid with a spout opening that is closed by an integrated over center latching assembly or over center leverage system. In some implementations, the over center latching assembly is attached to the lid by one or more pivot mounts or hinge connections located adjacent the spout on the top of the lid. In some implementations, the over center latching assembly includes one or more component parts, links or linkage mechanisms pivotally attached to the lid at the pivot mounts or hinges, which allows components elements of the over center latching assembly to pivot, rotate, translate or move from a closed and sealed position to an open position that allows access to the contents of the container. In some implementations, the over center latching assembly includes a cap which extends over the spout of the lid and a lever extending generally over the opposite side of the lid. In some implementations, the cap forms a seal with the spout (such as along the inside of the spout or against the top outlet of the spout) and, when closed, is held in place by pressure or compression created by the interaction of the spout and the various component parts of the over center latching assembly.

In some implementations, the lever is pivotally coupled to the cap and a link, the link, in turn, is pivotally coupled to the lid and the cap is also pivotally coupled to the lid. In some implementations, the cap is moved from the open position to the closed position by the application of an external force (such as from a user's finger) to the lever. In some implementations, as the external force is applied to the lever or the lever is otherwise pushed down, the coupling between the lever and the link results in the lever being wedged between the cap and the lid, thereby pushing the cap into a closed position. In some implementations, as the lever continues to move down, the cap comes into contact with the spout and causes pressure or compression to develop in the linkage comprising the over center latching assembly. In some implementations, due to the over center configuration of the linkage assembly, the compression or pressure holds the lever down in the closed position, which in turn is wedged against the cap thereby retaining the cap in the closed and sealed position.

In some implementations, the cap is moved from the closed position to the open position by reversing the operation previously described. In some implementations, the cap is moved from the closed position to the open position by the application of an external force to the lever sufficient to lift the lever up and overcome the compression or pressure between the over center linkage assembly and retract the cap. In some implementations, the over center latching assembly includes a spring which holds the cap in the open position.

Thus, some implementations of the invention provide a closure having an integrated over center latching assembly for use with a liquid container. In some implementations, the closure includes an end wall, a skirt wall depending from the end wall and an outlet opening associated with the end wall. In some implementations, the closure also includes an over center latching assembly. In some implementations, the over center latching assembly is pivotally coupled to the closure and is movable between a first position in which the outlet opening is exposed and a second position in which the outlet opening is covered by the over center latching assembly. In some implementations, the over center latching assembly includes a link that is pivotally coupled to the closure at a first pivot point, a lever pivotally coupled to the link at a second pivot point, a closing member pivotally coupled to the closure at a third pivot point and pivotally coupled to the lever at a forth pivot point and a biasing spring coupled between the first pivot point and the fourth pivot point. In some implementations, the link and the lever are configured to move the over center latching assembly between the first position and the second position, the closing member is configured to close the outlet opening when the over center latching assembly is moved to the second position and the biasing spring is configured to bias the over center latching assembly in the first position. In some implementations, the biasing spring is configured to provide a biasing force between the first and fourth pivot points.

Further implementation of the invention provides a closure having an integrated over center latching assembly for use with a liquid container. In some implementations, the closure includes an end wall, a skirt wall depending from the end wall, an outlet opening associated with the end wall and an over center latching assembly. In some implementations, the over center latching assembly is pivotally coupled to the closure and is movable between a first position in which the outlet opening is exposed and a second position in which the outlet opening is covered by the over center latching assembly. In some implementations, the closure is configured to be removably secured to a neck of a liquid container, such as a bottle, and to provide an essentially fluid-tight, liquid sealing and/or leak-proof seal with the container neck. In some implementations, the outlet opening permits access to the liquid contents, and the over center latching assembly seals the outlet opening to keep the liquid contents in the container and prevent spillage.

BRIEF DESCRIPTION OF THE SEVERAL VIEWS OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
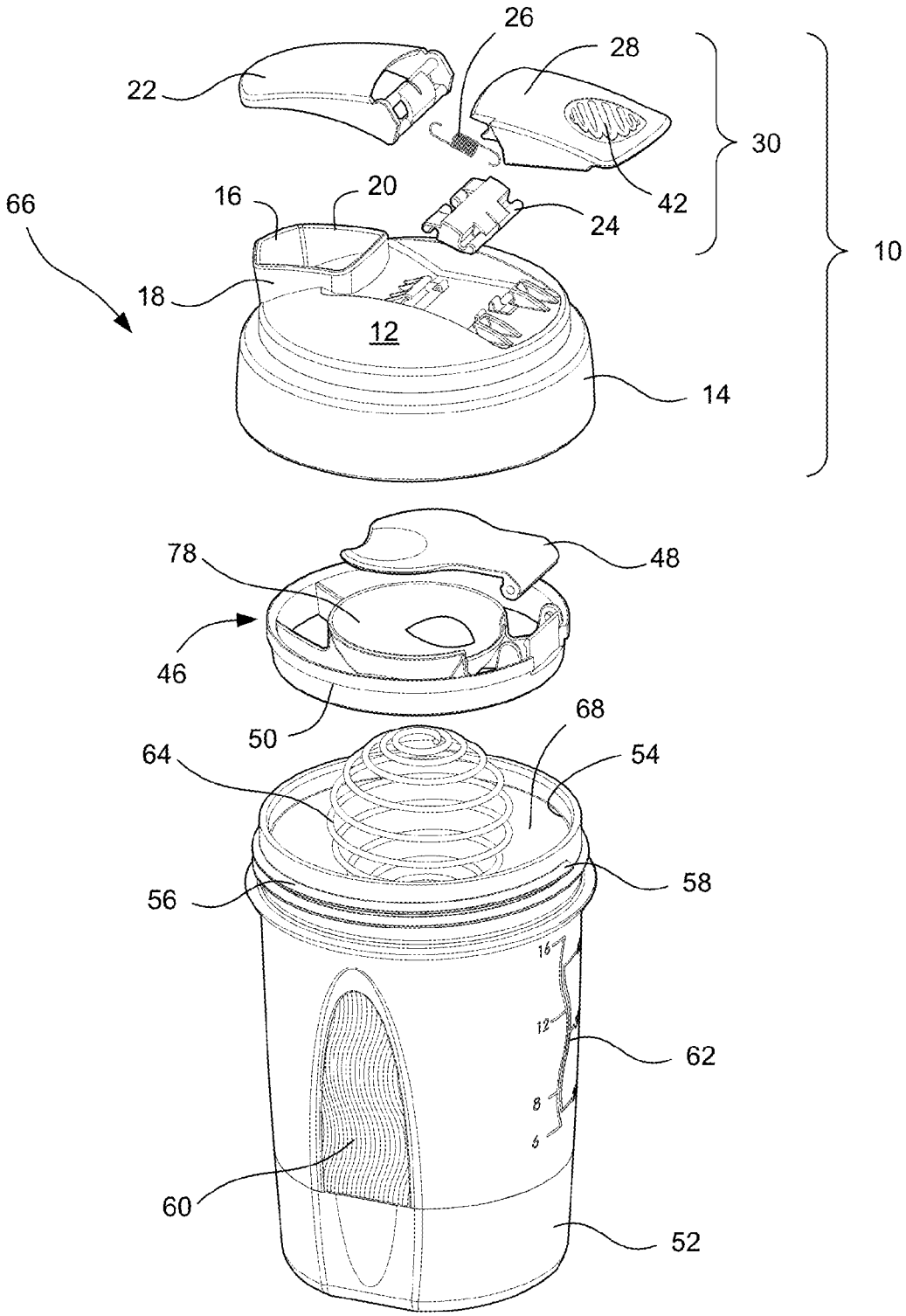
FIG. 1 illustrates an exploded perspective view of an embodiment of a bottle and closure system wherein the closure has an integrated over center latching assembly.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The description may use perspective-based descriptions such as up/down, back/front, left/right and top/bottom. Such descriptions are merely used to facilitate the discussion and are not intended to restrict the application or embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)", that is, A is an optional element.

Various operations may be described as multiple discrete operations in turn, in a manner that may be helpful in understanding embodiments of the present invention; however, the order of description should not be construed to imply that these operations are order dependent.

The description may use the phrases "in an embodiment," or "in various embodiments," which may each refer to one or more of the same or different embodiments. Furthermore, the terms "comprising," "including," "having," and the like, as used with respect to embodiments of the present invention, are synonymous with the definition afforded the term "comprising."

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical or electrical contact. However, "coupled" may also mean that two or more elements are not in direct contact with each other, but yet still cooperate or interact with each other.

As mentioned above, the present invention relates to closures incorporating an integrated latching assembly, and more particularly to closures with an integrated over center latching assembly for liquid containers such as bottles. Thus, a bottle/container closure with an integrated over center latching assembly is described.

Some embodiments of the invention provide a lid with a spout opening that is closed by an integrated over center latching assembly or over center leverage system. In various embodiments, the over center latching assembly is attached to the lid by one or more pivot mounts or hinge connections located adjacent the spout on the top of the lid. In further embodiments, the over center latching assembly includes one or more component parts, links or linkage mechanisms pivotally attached to the lid at the pivot mounts or hinges, which allows components elements of the over center latching assembly to pivot, rotate, translate or move from a closed and sealed position to an open position that allows access to the contents of the container. In some embodiments, the over center latching assembly includes a cap which extends over the spout of the lid and a lever extending generally over the opposite side of the lid. According to some embodiments, the cap forms a seal with the spout (such as along the inside of the spout or against the top outlet of the spout) and, when closed, is held in place by pressure or compression created by the interaction of the spout and the various component parts of the over center latching assembly.

In further embodiments, the lever is pivotally coupled to the cap and a link, the link, in turn, is pivotally coupled to the lid and the cap is also pivotally coupled to the lid. In such embodiments, the cap is moved from the open position to the closed position by the application of an external force (such as from a user's finger) to the lever. According to some embodiments, as the external force is applied to the lever or the lever is otherwise pushed down, the coupling between the lever and the link results in the lever being wedged between the cap and the lid thereby pushing the cap into a closed position. In various embodiments, as the lever continues to move down, the cap comes into contact with the spout and causes pressure or compression to develop in the linkage comprising the over center latching assembly. In some embodiments, due to the over center configuration of the linkage assembly, the compression or pressure holds the lever down in the closed position, which in turn is wedged against the cap thereby retaining the cap in the closed and sealed position.

In further embodiments, the cap is moved from the closed position to the open position by reversing the operation previously described. In such embodiments, the cap is moved from the closed position to the open position by the application of an external force to the lever sufficient to lift the lever up and overcome the compression or pressure between the over center linkage assembly and retract the cap. In various embodiments, the over center latching assembly includes a spring which holds the cap in the open position.

Thus, some embodiments of the invention provide a closure having an integrated over center latching assembly for use with a liquid container. According to some embodiments, the closure includes an end wall, a skirt wall depending from the end wall and an outlet opening associated with the end wall. In various embodiments, the closure also includes an over center latching assembly. In further embodiments, the over center latching assembly is pivotally coupled to the closure and is movable between a first position in which the outlet opening is exposed and a second position in which the outlet opening is covered by the over center latching assembly. In some embodiments, the over center latching assembly includes a link that is pivotally coupled to the closure at a first pivot point, a lever pivotally coupled to the link at a second pivot point, a closing member pivotally coupled to the closure at a third pivot point and pivotally coupled to the lever at a forth pivot point and a biasing spring coupled between the first pivot point and the fourth pivot point. In further embodiments, the link and the lever are configured to move the over center latching assembly between the first position and the second position, the closing member is configured to close the outlet opening when the over center latching assembly is moved to the second position and the biasing spring is configured to bias the over center latching assembly in the first position. In other embodiments, the biasing spring is configured to provide a biasing force between the first and fourth pivot points.

Further embodiments of the invention provide a closure having an integrated over center latching assembly for use with a liquid container. In such implementations, the closure includes an end wall, a skirt wall depending from the end wall, an outlet opening associated with the end wall and an over center latching assembly. In various embodiments, the over center latching assembly is pivotally coupled to the closure and is movable between a first position in which the outlet opening is exposed and a second position in which the outlet opening is covered by the over center latching assembly. According to some embodiments, the closure is configured to be removably secured to a neck of a liquid container, such as a bottle, and to provide an essentially fluid-tight, liquid sealing and/or leak-proof seal with the container neck. In various embodiments, the outlet opening permits access to the liquid contents, and the over center latching assembly seals the outlet opening to keep the liquid contents in the container and prevent spillage.

With reference now to the figures, FIG. 1 shows an exploded perspective view of one embodiment of a system 66 comprised of a bottle or liquid container 52 and a closure 10. As depicted, in some embodiments the bottle/container and closure system 66 only include bottle 52 and closure 10. In other embodiments, however, system 66 further comprises a blending or whisk ball 64 and/or an egg separator 46. In embodiments contemplating the inclusion of egg separator 46, bottle 52 further comprises an internal circumferential lip, integrally formed ring or ledge 54 configured to retain egg separator 46 within a reservoir 68 defined by the bottle 52. In such embodiments, egg separator 46 may remain retained within reservoir 68 when closure 10 is secured to bottle 52. Further, according to such embodiments, egg separator 46 further comprises a corresponding circumferential lip, integrally formed ring or ledge 50 configured to engage the bottle lip 54 so as to retain egg separator 46 within bottle 52 when closure 10 is affixed to the bottle. In embodiments contemplating the inclusion of the egg separator 46, the separator 46 is removable for cleaning or if the user simply does not require or prefer use of the same. In addition, in such embodiments, egg separator 46 further comprises components common to those of skill in the art such as handle 48 and/or yolk cavity 78. The handle 48 is foldable so as to permit the separator 46 to be disposed within the reservoir 68 when the closure 10 is secured to the bottle 52.

In various embodiments, bottle 52 also comprises additional features. In some embodiments, for example, bottle 52 includes an integrated measuring system 62. While FIG. 1 depicts specific numerical figures, such is for illustrative purposes and is not intended to be limiting. Thus, according to some embodiments any suitable or desirable bottle size is contemplated and any suitable or desirable metric may be used to denote the measured contents of the bottle. In some embodiments, one or more integrated measuring systems 62 are disposed at various locations around the circumference of bottle 52 such that the user can read or interpret the volume of contents contained in bottle 52 from one or more orientations corresponding with the measuring systems 62. In some additional embodiments, bottle 52 includes a gripping surface 60 configured to facilitate manual handling of bottle 52. In some embodiments, gripping surface 60 includes one or more bumps, ridges, lines, protuberances, crests, folds, knobs, bulges, lumps or other protrusions configured to facilitate and enhance a user's grip of the bottle. In some embodiments, formations are selected for their ability to minimize condensation on the gripping surface to thereby minimize the risk of having the bottle slip out of the user's grasp.

With continued reference to FIG. 1, in some embodiments closure 10 includes an end wall 12 and a skirt wall 14 depending from end wall 12. In such embodiments, end wall 12 and skirt wall 14 serve to close the liquid container or bottle 52, and skirt wall 14 may include any means for securing closure 10 to liquid container/bottle 52, such as threads, a ridge for a press or snap fit, or any similar structure, as known in the art. For example, in some embodiments, as depicted in FIG. 1, bottle 52 includes external threads 56 disposed on the neck of bottle 52. In such embodiments, skirt wall 14 includes corresponding internal threads (seen in cross-section at 44 in FIGS. 3-5) for securing closure 10 to liquid container 52. In various embodiments, sealing means common to those of skill in the art are used to facilitate a liquid sealing engagement between closure 10 and bottle 52.

In some embodiments, external threads 56 include a terminal abutment or shoulder 58. In such embodiments, internal threads 44 include a corresponding terminal abutment (not shown). In this way, closure 10 is secured to liquid container 52 by matingly engaging external threads 56 with internal threads 44 and rotating closure 10 in an appropriate direction (some embodiments contemplate left-handed threading while other embodiments contemplate right-handed threading) until the corresponding terminal abutments associated with internal threads 44 and external threads 56 meet thereby arresting the user's ability to threadingly rotate closure 10. In this way, closure 10 can be repeatedly and consistently secured to bottle 52 so as to always maintain a liquid sealing engagement therewith without over tightening closure 10 and either deforming or damaging the component parts of system 66. In addition, in such embodiments where it is desirable to maintain a specific mating orientation between closure 10 and bottle 52 such can be accomplished by positioning shoulder 58 at an appropriate location during the manufacturing process. For example, in embodiments contemplating a gripping surface 60, a measuring system 62 or other similar convenient features, shoulder or terminal abutment 58 can be located such that closure 10 is always oriented in the same direction relative to either gripping surface 60, measuring system 62 or other similar features when closure 10 is fully secured to bottle 52. In this way, the convenience and efficacy of various features included with bottle 52 are enhanced. Moreover, the user is able to determine whether closure 10 is fully secured to bottle 52 simply by a visual inspection.

Figure 2:
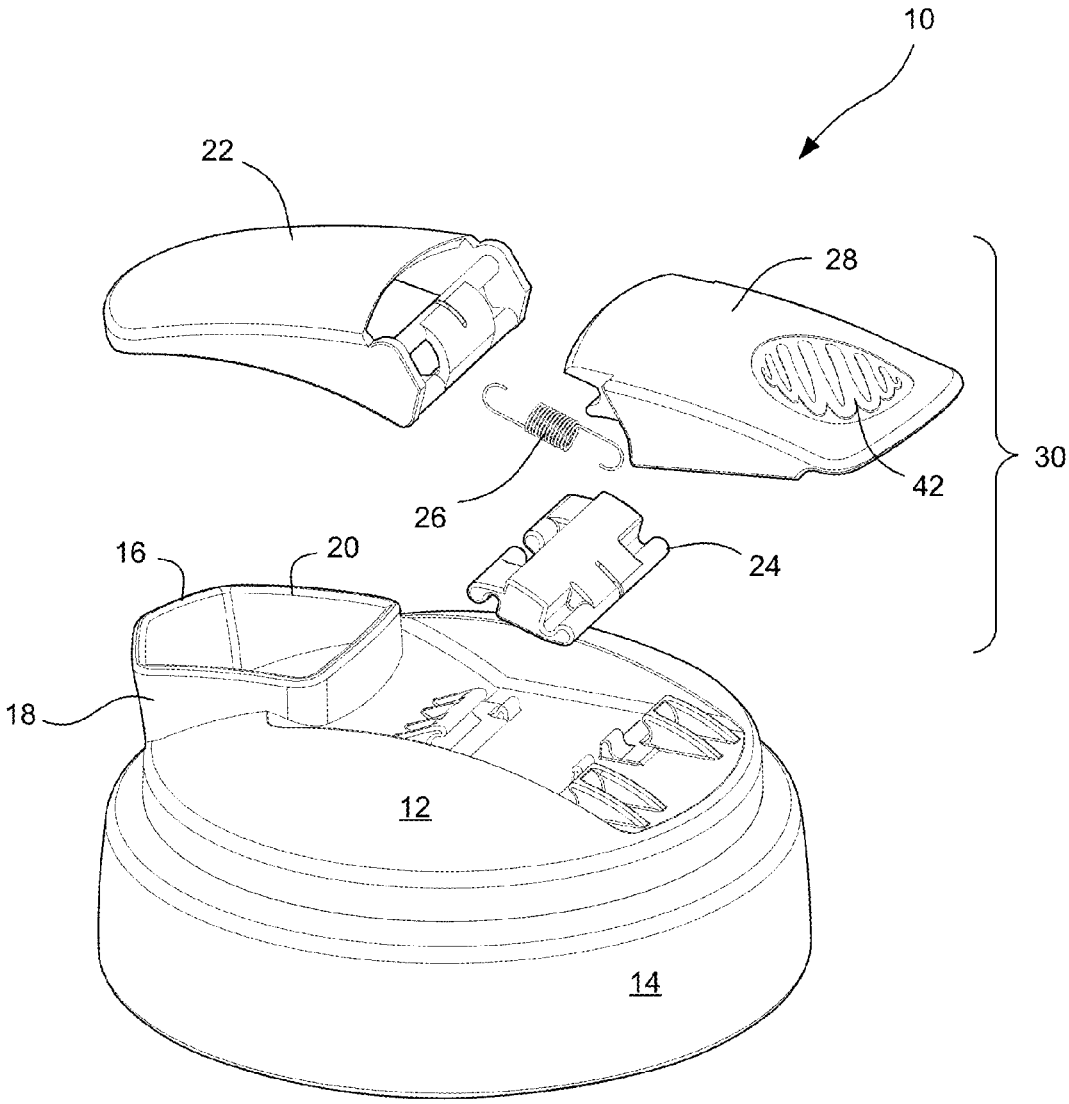
FIG. 2 illustrates an exploded perspective view of an embodiment of a bottle closure with an integrated over center latching assembly.

Turning now to FIG. 2, various embodiments of closure 10 will be discussed in further detail. As shown, FIG. 2 illustrates an enlarged exploded perspective view of an embodiment of a bottle closure 10 with an integrated over center latching assembly 30. As mentioned above, in some embodiments closure 10 includes an end wall 12 and a skirt wall 14 depending from end wall 12. In various embodiments, the closure 10 further includes an outlet opening 16 (e.g. a spout) associated with the end wall 12. In such embodiments, the outlet opening 16 provides access to the contents of the liquid container 52 (not shown in FIG. 2) without requiring removal of the entire closure 10 from the liquid container 52. In the embodiment illustrated in the Figures, the outlet opening 16 terminates a spout 18 extending from the end wall 12.

In various embodiments, over center latching assembly 30 is comprised of various additional elements. As seen in FIGS. 1 and 2, some embodiments of over center latching assembly 30 are comprised of a closing member or spout cap 22, a link 24, a biasing spring 26 and a lever 28. In some embodiments, a gripping means or surface 42 is formed or disposed on lever 28. In some additional embodiments, a sealing material, such as a soft durometer rubber or other similar material adapted to facilitate a liquid sealing engagement between two parts is disposed on the underside of closing member 22. In other embodiments, such a material is disposed around or adjacent the opening 16. In still further embodiments, such a material is disposed on both the underside of closing member 22 and the contact surface of opening 16 or the surface of opening 16 which closing member 22 contacts when the over center latching assembly 30 is moved to a closed position. In yet additional embodiments, one or more ridges 20 may be formed in either the underside of closing member 22, the opening 16, or a sealing material associated with either of the forgoing to further enhance a liquid sealing engagement between opening 16 and closing member 22.

In various embodiments, closure 10 includes additional features such as pivot mounts or hinges to facilitate coupling closing member 22, link 24, spring 26 and/or lever 28 to closure 10 such that the foregoing components are configured to interact with each other and closure 10 in order to render over center latching assembly 30 pivotally coupled to closure 10 and movable between a first position in which outlet opening 16 is exposed or open such that the contents of bottle 52 can pass through and a second position in which outlet opening 16 is covered by the over center latching assembly 30. More specifically, in some embodiments, outlet opening 16 is covered by closing member or cap 22 when the over center latching assembly 30 is moved to the second position. The interactions described generally above will be discussed in more detail with reference to the remaining figures.

Figure 3:
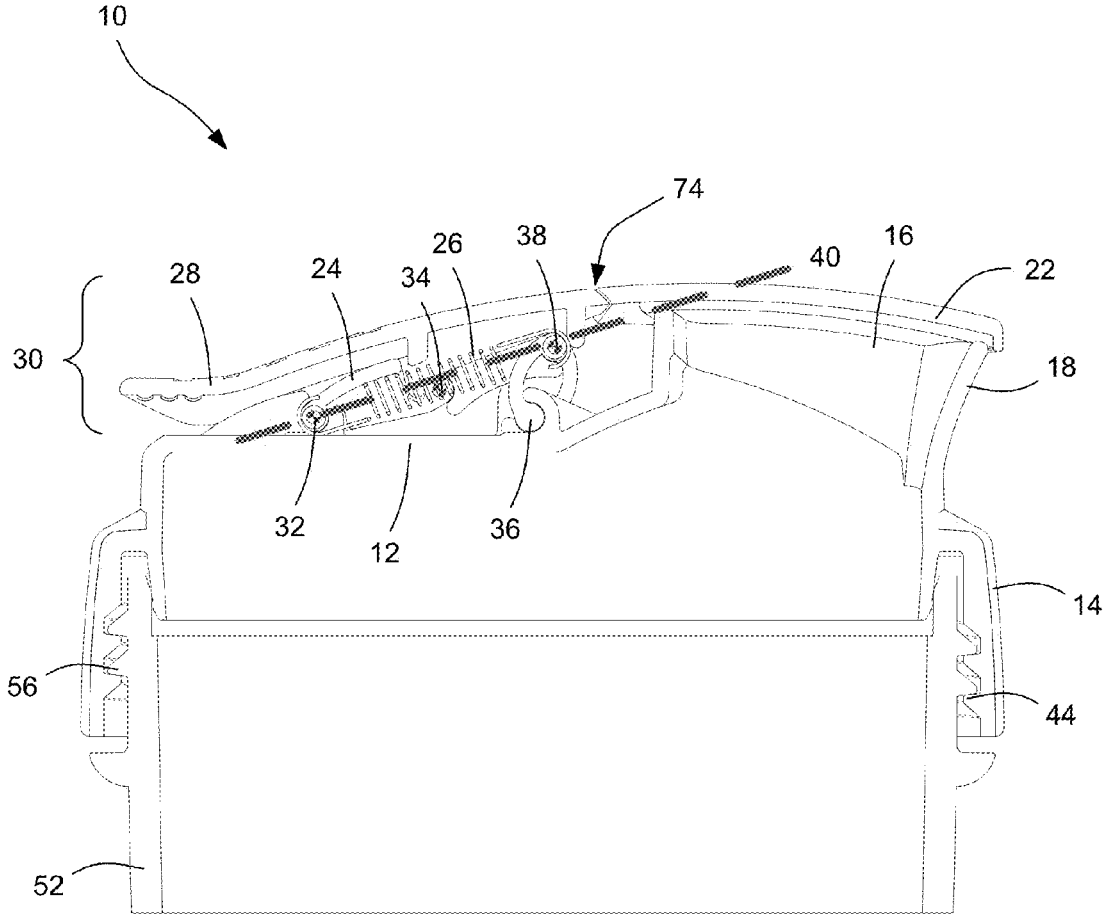
FIG. 3 illustrates a cross-sectional side view of an embodiment of a bottle closure with an integrated over center latching assembly in a closed position.
Figure 4:
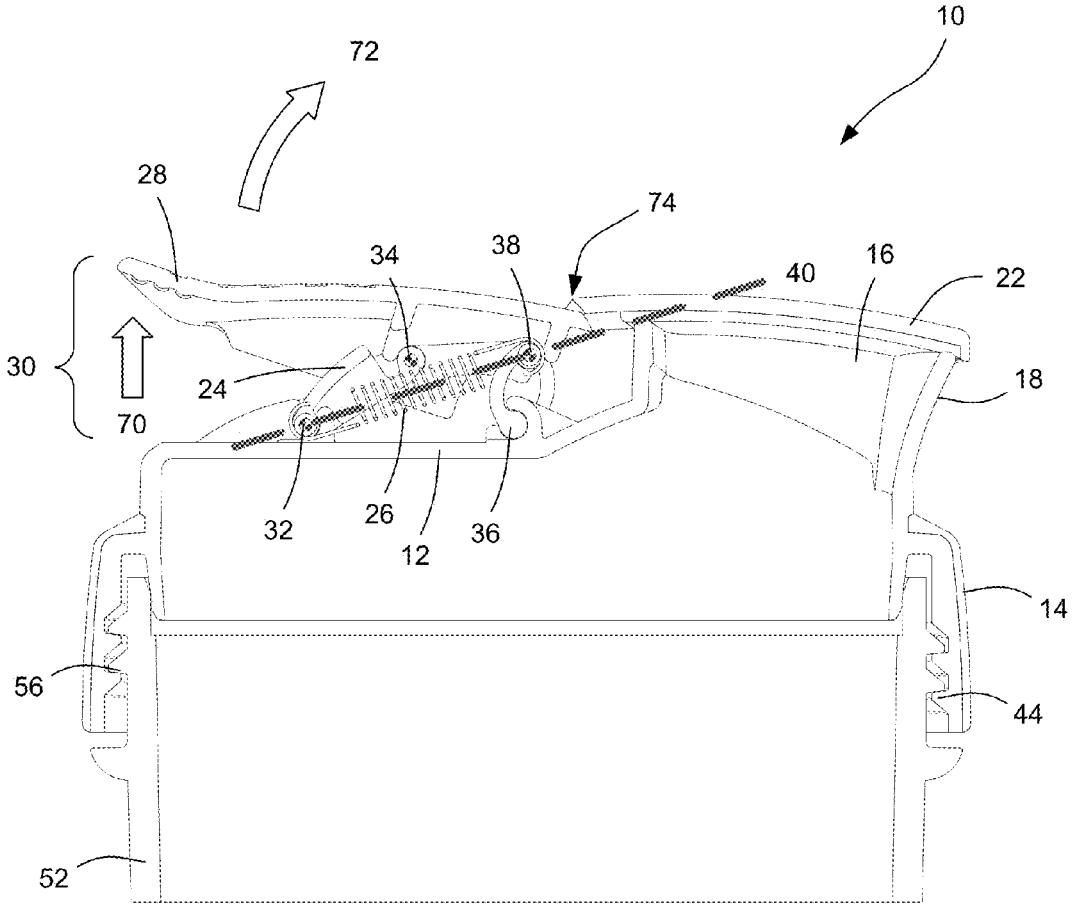
FIG. 4 illustrates a second cross-sectional view thereof with the over center latching assembly in a partially open position.
Figure 5:
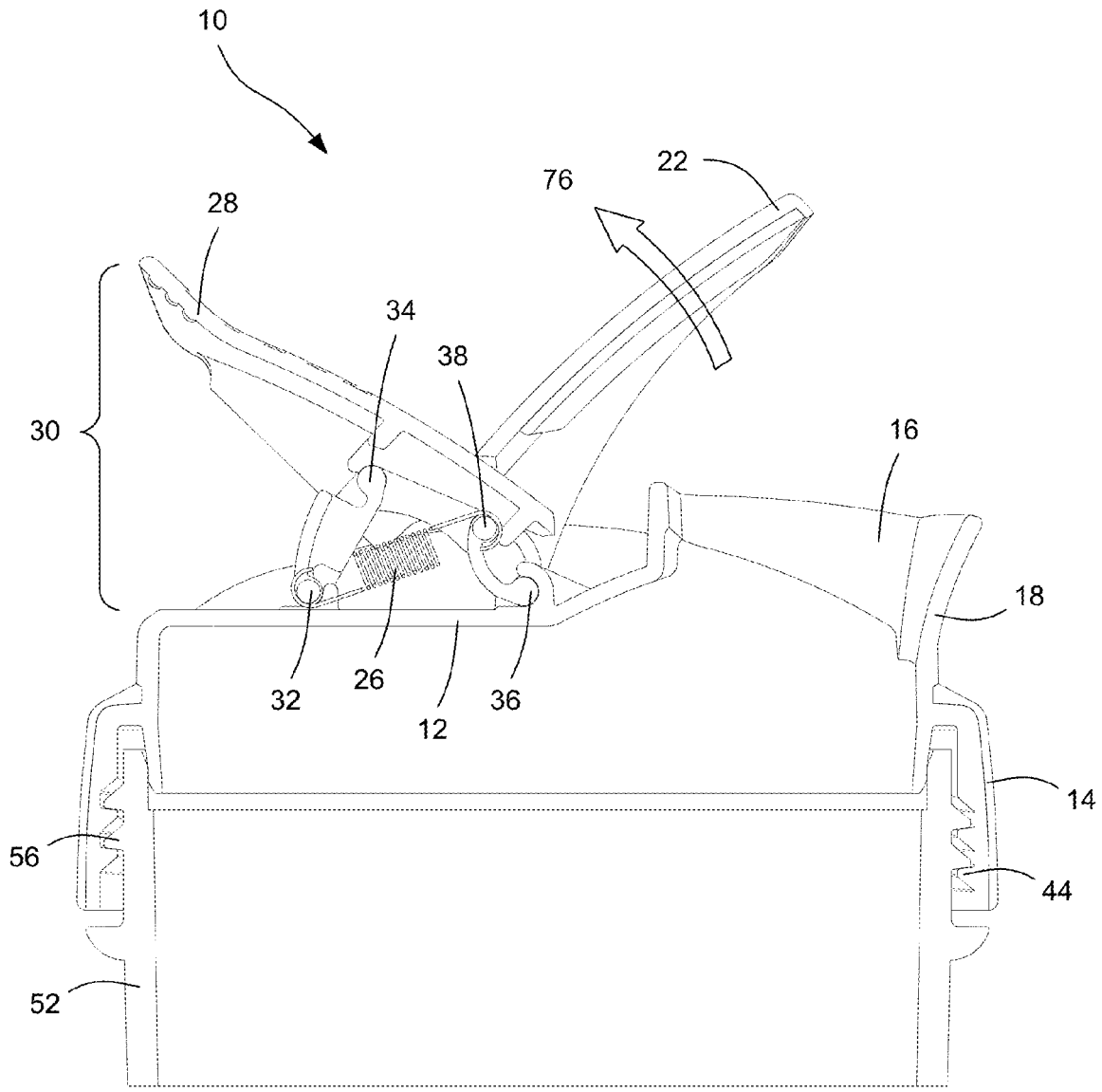
FIG. 5 illustrates a third cross-sectional view thereof with the over center latching assembly in an open position.

Turning to FIG. 3, a cross-sectional side view of an embodiment of a bottle closure 10 with an integrated over center latching assembly 30 in a closed position is illustrated. The remaining figures, FIGS. 4 and 5, depict the same cross-sectional view of the embodiment of closure 10 depicted in FIG. 3 as the over center latching assembly 30 is moved from the closed position seen in FIG. 3 to the open position seen in FIG. 5. FIG. 4 illustrates an embodiment of closure 10 wherein the over center latching assembly 30 occupies a partially open position.

With continued reference to FIG. 3, the operation of over center latching assembly 30, according to some embodiments, will now be described in greater detail. As seen in FIG. 3, some embodiments of over center latching assembly 30 include a first pivot point 32 defined by a pivotable junction between link 24 and a pivot mount or hinge mount associated with end wall 12 of closure 10. In other words, in such embodiments, link 24 is pivotally coupled to closure 10 at first pivot point 32. In additional embodiments, a second pivot point 34 is defined by a pivotable junction between lever 28 and an end of link 24 opposite the end associated with first pivot point 32. In other words, in such embodiments, lever 28 is pivotally coupled to link 24 at second pivot point 34. In a similar fashion to the first and second pivots points 32, 34, according to some embodiments, a third pivot point 36 is defined between closing member 22 and end wall 12 and a fourth pivot point 38 is defined between closing member 22 and lever 28. In other words, in some embodiments, closing member 22 is pivotally coupled to closure 10 at third pivot point 36 and pivotally coupled to lever 28 at fourth pivot point 38. In some embodiments, first pivot point 32 and third pivot point 36 are static pivot points while second pivot point 34 and fourth pivot point 38 are dynamic pivot points.

As may be seen in FIG. 3, the static pivot points, e.g. first pivot point 32 and third pivot point 36 are associated with static positions on end wall 12. First pivot point 32 is located on end wall 12 more distal from outlet opening 16, while third pivot point 36 is located on end wall 12 more proximate to outlet opening 16. When over center latching assembly 30 is in the closed position shown in FIG. 3, fourth pivot point 38 is located above third pivot point 36 and slightly more proximate outlet opening 16 than third pivot point 36; however, as the latching assembly 30 is opened as shown in and discussed with reference to FIGS. 4 and 5, fourth pivot point 38 rotates around third pivot point 36 away from outlet opening 16 until fourth pivot point 38 is more distal outlet opening 16 than third pivot point 36. When over center latching assembly 30 is in the closed position shown in FIG. 3, second pivot point 34 is located approximately between first pivot point 32 and fourth pivot point 38, and just below a plane bisecting first pivot point 32 and fourth pivot point 38, as will be discussed further below.

In various embodiments, the linkages described above between the components of over center latching assembly 30 are such that link 24 and lever 28 are configured to move over center latching assembly 30 between the closed position and the open position and closing member 22 is configured to close outlet opening 16 when the over center latching assembly 30 is moved into the closed position. In some embodiments, spring 26 is pivotally coupled between first pivot point 32 and fourth pivot point 38. In such embodiments, spring 26 is configured to bias over center latching assembly 30 in the open position. In other embodiments, spring 26 is configured to continuously provide a biasing force between first pivot point 32 and fourth pivot point 38.

According to some embodiments, as seen in FIG. 3, the over center latching assembly 30 comprised of closing member 22, link 24, spring 26 and lever 28 is configured such that when over center latching assembly 30 is in the closed position, second pivot point 34 is below a pressure axis 40 defined between first pivot point 32 and fourth pivot point 38. In this way, when over center latching assembly 30 is in the closed position, the assembly linkage is subject to pressure or is under compression such that closing member 22 remains pressed against opening 16 and lever 28 abuts end wall 12. In other words, when over center latching assembly 30 occupies the closed position, second pivot point 34 is "over center" with respect to axis 40 thus putting the assembly linkage into compression and maintaining the assembly in the closed position. In such embodiments, spring 26 also contributes to the biasing force maintaining over center latching assembly 30 in the closed position by providing a biasing force between first pivot point 32 and fourth pivot point 38. In some embodiments, lever 28 is wedged against closing member 22 at point 74 when the assembly is in the closed position thereby retaining the cap in the closed and sealed position. In this way, closing member 22 is restrained against opening and is resistant to pressure or other forces from within bottle 52 as well as to externally applied forces, such as to a lip or edge of closing member 22.

Turning to FIG. 4, in some embodiments, as an upward force 70 is applied to an end of lever 28 distal from fourth pivot point 38 sufficient to overcome the biasing pressure or compression force created by second pivot point 34 being over the axis 40 defined between first pivot point 32 and fourth pivot point 38, lever 28 is permitted to rotate upward in the direction 72. In such embodiments, as lever 28 continues to rotate upward in the direction 72, the upward rotation of second pivot point 34 on link 24 forces lever 28 away from opening 16, which causes lever 28 to disengage closing member 22 from opening 16. Continued movement of lever 28 in direction 72 begins to retract closing member 22 via the pivotal engagement between lever 28 and closing member 22 at fourth pivot point 38. In addition, according to such embodiments, as lever 28 is raised and second pivot point 34 moves above axis 40, spring 26 biases the over center latching assembly 30 toward the open position by providing a biasing force between first pivot point 32 and fourth pivot point 38.

With reference to FIG. 5, according to some embodiments, as lever 28 is raised to its maximum height (or the height corresponding with a fully open position) under the biasing force provided by spring 26, closing member 22 rotates upward in the direction 76 until it achieves a fully retracted or open position and opening 16 is exposed. In such embodiments, spring 26 biases the over center latching assembly 30 such that it maintains the open position absent an external force applied downward to lever 28 which is sufficient to overcome the biasing force of spring 26. As may be seen in FIG. 5, the opening action has caused second pivot point 34 to rotate around first pivot point 36 to a point above and more distal from the outlet opening 16 from the location of second pivot point 34 when over center latching assembly 30 is closed as depicted in FIG. 3.

With reference to FIGS. 3 through 5 in the opposite direction, the closing operation of the over center latching assembly 30 will now be described in accordance with some embodiments. As shown in FIG. 5, where the over center latching assembly 30 begins in the open position, as an external force (not shown) is applied downward against the top of lever 28, lever 28 is leveraged against closure 10 via link 24 and as a result pushes against closing member 22 causing it to rotate down in the direction opposite arrow 76 such that closing member 22 closes off opening 16. Turning to FIG. 4, as lever 28 continues to move downward in a direction opposite arrow 72, second pivot point 34 approaches the pressure axis 40 defined between first pivot point 32 and fourth pivot point 38. As second pivot point 34 increasingly approaches pressure axis 40, closing member 22 comes into contact with spout opening 16 as seen in FIG. 4. As second pivot point 34 continues to rotate around first pivot point 32 toward axis 40, the contact between closing member 22 and opening 16 causes the pressure to increase between the linkage of the over center latching assembly 30, and particularly between first pivot point 32 and fourth pivot point 38. Turning to FIG. 3, as second pivot point 34 finally moves below axis 40, the lever 28 comes into contact with end wall 12. The pressure on second pivot point 34 would continue to drive point 34 further due to the reversed angle of the linkage but for contact between lever 28 and end wall 12. In this way, the pressure in the linkage and the opposing force provided by end wall 12 causes second pivot point 34 to remain "over center" with respect to axis 40 such that lever 28 is retained in a closed position and closing member 22 is held tight against opening 16 so as to form a fluid-tight engagement therewith. As mentioned above, in some embodiments, lever 28 is wedged against closing member 22 at point 74 when the assembly is in the closed position thereby retaining the cap in the closed and sealed position. In this way, closing member 22 is restrained against opening and is resistant to pressure or other forces from within bottle 52 as well as to pressure or other forces externally applied to closing member 22.

In various embodiments, with brief reference back to FIG. 1, the system 66 is configured for one handed or singled handed operation and/or use. Specifically, in such embodiments, a user is able to use one hand to pick up bottle 52, shake bottle 52 (to mix the contents thereof, which in some embodiments is augmented or assisted by whisk ball 64), open bottle 52 by applying an upward force to lever 28 with an index finger or thumb, dispensing the contents of bottle 52, closing the over center latching assembly 30 by applying a downward force to lever 28 with the index finger or thumb and returning the bottle to the surrounding environment. In this way, system 66 may be conveniently used in a variety of settings, including outdoor settings, where the user is mobile and the like.

Thus, as discussed herein, various embodiments of the present invention embrace closures incorporating an integrated latching assembly, and more particularly closures with an integrated over center latching assembly for liquid containers such as bottles.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A closure having an integrated over center latching assembly for use with a liquid container, comprising:

an end wall;

a skirt wall depending from the end wall;

an outlet opening associated with the end wall; and an over center latching assembly pivotally coupled to the closure, the over center latching assembly being movable between a first position in which the outlet opening is exposed and a second position in which the outlet opening is covered by the over center latching assembly, the over center latching assembly comprising:

a link pivotally coupled to the closure at a first pivot point;

a lever pivotally coupled to the link at a second pivot point;

a closing member pivotally coupled to the closure at a third pivot point and pivotally coupled to the lever at a fourth pivot point; and a biasing spring coupled between the first pivot point and the fourth pivot point, wherein the link and the lever are configured to move the over center latching assembly between the first position and the second position, the closing member is configured to close the outlet opening when the over center latching assembly is moved to the second position and the biasing spring is configured to bias the over center latching assembly in the first position.

2. A closure as recited in claim 1, wherein the over center latching assembly is configured to transmit an external force applied from the lever to the link and the closing member simultaneously such that the bias provided by the spring is overcome and the closing member is moved into the second position.

3. A closure as recited in claim 2, wherein the first pivot point and the fourth pivot point define a pressure axis.

4. A closure as recited in claim 3, wherein the first pivot point and the third pivot point are static and the second pivot point and the fourth pivot point are dynamic.

5. A closure as recited in claim 4, wherein the second pivot point is located on a first side of the pressure axis when the over center latching assembly occupies the first position and the second pivot point is moved to a second side of the pressure axis opposite the first side of the pressure axis as the external force is applied from the lever and the over center latching assembly is moved into the second position.

6. A closure as recited in claim 5, wherein the lever is forced against the closing member via the link as the external force is applied and the over center latching assembly is moved into the second position such that the closing member contacts the outlet opening.

7. A closure as recited in claim 6, wherein pressure increases between the first pivot point and the fourth pivot point as the closing member comes into contact with the outlet opening and wherein the pressure increase biases the second pivot point on the second side of the pressure axis such that the over center latching assembly is biased in the second position.

8. A closure as recited in claim 1, wherein the closing member forms a liquid seal with the outlet opening when the over center latching assembly is moved to the second position.

9. A closure as recited in claim 1, further comprising a spout extending from the end wall and terminating in the outlet opening, the spout defining a flow path through the end wall to the outlet opening.

10. A closure as recited in claim 1, further comprising a gripping means disposed on the lever.

11. A closure as recited in claim 1, further comprising threads configured to secure the closure to a liquid container.

12. A closure and liquid container system configured for single handed use, comprising:

a liquid container; and a closure configured to form a liquid sealing engagement with the liquid container, comprising:

an end wall;

a skirt wall depending from the end wall;

an outlet opening associated with the end wall; and an over center latching assembly pivotally coupled to the closure, the over center latching assembly being movable between a first position in which the outlet opening is exposed and a second position in which the outlet opening is covered by the over center latching assembly, the over center latching assembly comprising:

a link pivotally coupled to the closure at a first pivot point;

a lever pivotally coupled to the link at a second pivot point;

a closing member pivotally coupled to the closure at a third pivot point and pivotally coupled to the lever at a fourth pivot point and a biasing spring coupled between the first pivot point and the fourth pivot point, wherein the link and the lever are configured to move the over center latching assembly between the first position and the second position, the closing member is configured to close the outlet opening when the over center latching assembly is moved to the second position and the biasing spring is configured to provide a biasing force between the first and fourth pivot points.

13. The closure and liquid container system of claim 12, further comprising an axis generally aligned with the first pivot point and the fourth pivot point, the second pivot point disposed on a first side of the axis when the over center latching assembly is in the first position, the second pivot point disposed on a second side of the axis when the over center latching assembly is in the second position.

14. The closure and liquid container system of claim 12, wherein the over center latching assembly is configured to transmit an external force applied from the lever to the link and the closing member simultaneously such that the bias provided by the spring is overcome and the closing member is moved into the second position.

15. The closure and liquid container system of claim 14, wherein the over center latching assembly is configured to be biased in the second position by the interaction of the first, second, third and forth pivot points, the biasing spring, the lever, the closing member and the outlet opening.

16. The closure and liquid container system of claim 12, further comprising external threads disposed on the liquid container and corresponding internal threads disposed on the closure to facilitate a liquid sealing engagement between the closure and the liquid container.

17. The closure and liquid container system of claim 16, wherein the internal threads and the external threads terminate in a corresponding abutment defining a fully closed liquid sealing engagement between the closure and the liquid container.

18. The closure and liquid container system of claim 12, further comprising one of a whisk ball, an egg separator, a gripping surface and an integrated measuring system.

19. A closure having an integrated over center latching assembly for use with a liquid container, comprising:

an outlet opening; and an over center latching assembly pivotally coupled to the closure, the over center latching assembly being movable between a first position in which the outlet opening is exposed and a second position in which the outlet opening is covered by the over center latching assembly, the over center latching assembly comprising:

a link pivotally coupled to the closure at a first pivot point;

a lever pivotally coupled to the link at a second pivot point;

a closing member pivotally coupled to the closure at a third pivot point and pivotally coupled to the lever at a fourth pivot point and a biasing spring coupled between the first pivot point and the fourth pivot point, wherein the link and the lever are configured to move the over center latching assembly between the first position and the second position, the closing member is configured to close the outlet opening when the over center latching assembly is moved to the second position and the biasing spring is configured to provide a biasing force between the first and fourth pivot points.

20. A closure as recited in claim 19, further comprising an axis generally aligned with the first pivot point and the fourth pivot point, the second pivot point disposed on a first side of the axis when the over center latching assembly is in the first position, the second pivot point disposed on a second side of the axis when the over center latching assembly is in the second position.

21. A closure for use with a liquid container, the closure comprising:

an end wall;

a skirt wall depending from the end wall;

an outlet disposed in the end wall;

a lever pivotally coupled to the end wall about a first axis of rotation, the lever movable between a first position and a second position;

a closing member pivotally coupled to the end wall about a second axis of rotation, the closing member movable between a closed position in which the closing member closes the outlet and an open position in which the closing member does not close the outlet; and a link pivotally coupled to the lever about a third axis of rotation, the third axis of rotation movable relative to the end wall when the lever is moved between the first and second positions and the closing member is moved between the open and closed positions, the link, the closing member and the lever being coupled so that movement of the lever between the first and second positions causes movement of the link and closing member;

wherein when the lever is in the first position, the closing member is in the open position;

wherein when the lever is in the second position, the closing member is in the closed position;

wherein when the lever is moved from the first position to the second position, the link pivots about the third axis of rotation, the third axis of rotation is moved relative to the end wall and the closing member moves from the open position to the closed position; and wherein when the lever is moved second position to the first position, the link pivots about the third axis of rotation, the third axis of rotation is moved relative to the end wall and the closing member moves from the closed position to the open position.

22. The closure as in claim 21, wherein the first axis of rotation is disposed in a fixed position relative to the end wall.

23. The closure as in claim 21, wherein the second axis of rotation is disposed in a fixed position relative to the end wall.

24. The closure as in claim 21, wherein the closing member is pivotally coupled to the lever about a fourth axis of rotation.

25. The closure as in claim 21, wherein the first axis of rotation is disposed in a fixed position relative to the end wall; and wherein the second axis of rotation is disposed in a fixed position relative to the end wall.

* * * * *